United States Patent [19]

Stafford

[11] Patent Number: 4,919,631

[45] Date of Patent: Apr. 24, 1990

[54] UNDERWATER DIVING SYSTEM

[76] Inventor: Michael V. Stafford, 419 Main St., Suite 212, Placerville, Calif. 95667

[21] Appl. No.: 190,631

[22] Filed: May 5, 1988

[51] Int. Cl.[5] ..... B63C 11/20

[52] U.S. Cl. ..... 441/40; 114/315; 405/186

[58] Field of Search ..... 114/66, 315; 405/185, 405/186; 441/35, 36, 40, 129, 135, 136

[56] References Cited

U.S. PATENT DOCUMENTS

| | | | |
|---|---|---|---|
| 1,401,724 | 12/1921 | Palij | 405/186 X |
| 3,324,819 | 6/1967 | Tetyak | 114/66 X |
| 3,566,425 | 3/1971 | Welty | 114/345 |
| 4,348,976 | 9/1982 | Gilbert | 114/315 X |
| 4,674,493 | 6/1987 | Mitchell | 405/186 X |

FOREIGN PATENT DOCUMENTS

| | | |
|---|---|---|
| 2635617 | 2/1978 | Fed. Rep. of Germany . |
| 3513515 | 10/1986 | Fed. Rep. of Germany . |
| 1522520 | 3/1968 | France . |
| 2036255 | 12/1970 | France . |
| 2119265 | 8/1972 | France . |
| 2148128 | 5/1985 | United Kingdom . |

OTHER PUBLICATIONS

Brownie's Third Lung Advertisement, Fort Lauderdale, Fla.

Brownie's Third Lung Brochure article (undated), Maui News.

*Primary Examiner*—Sherman D. Basinger

*Attorney, Agent, or Firm*—Bernhard Kreten

[57] ABSTRACT

An underwater diving system including a raft configured to support and carry a compressed air tank in such a manner that the raft is extremely stable and is self-bailing and self-righting because of its configuration, a diving harness communicating with the on-board compressed air source so that the diver is tethered and tows the raft while diving underwater at nominal depths up to 20 feet, for example. The diving system described herein bridges the gap that exists between snorkeling and scuba diving.

27 Claims, 2 Drawing Sheets

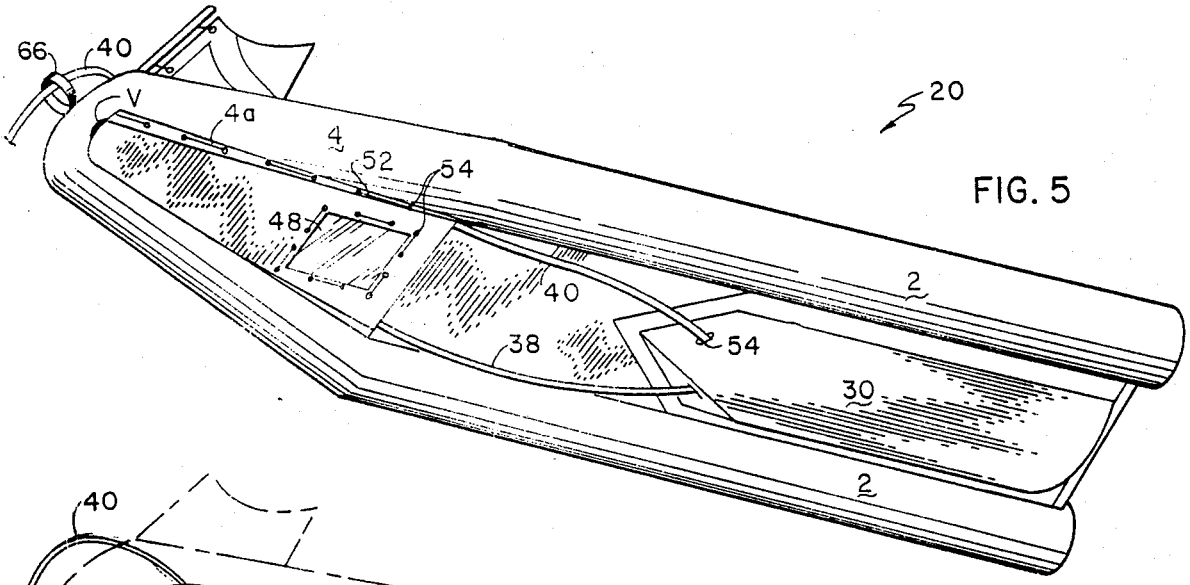
FIG. 5
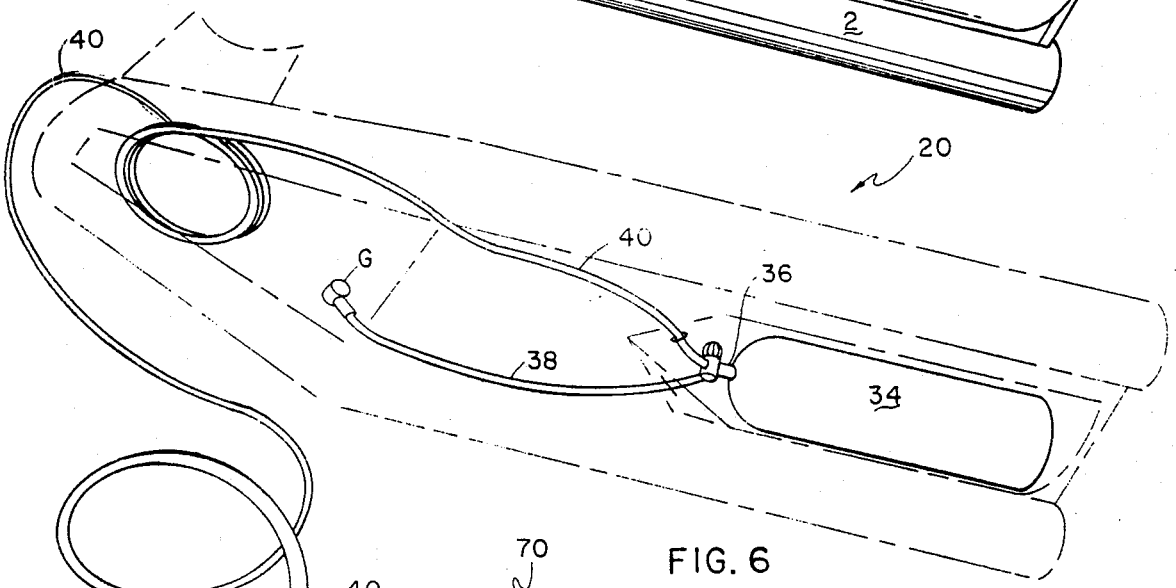
FIG. 6
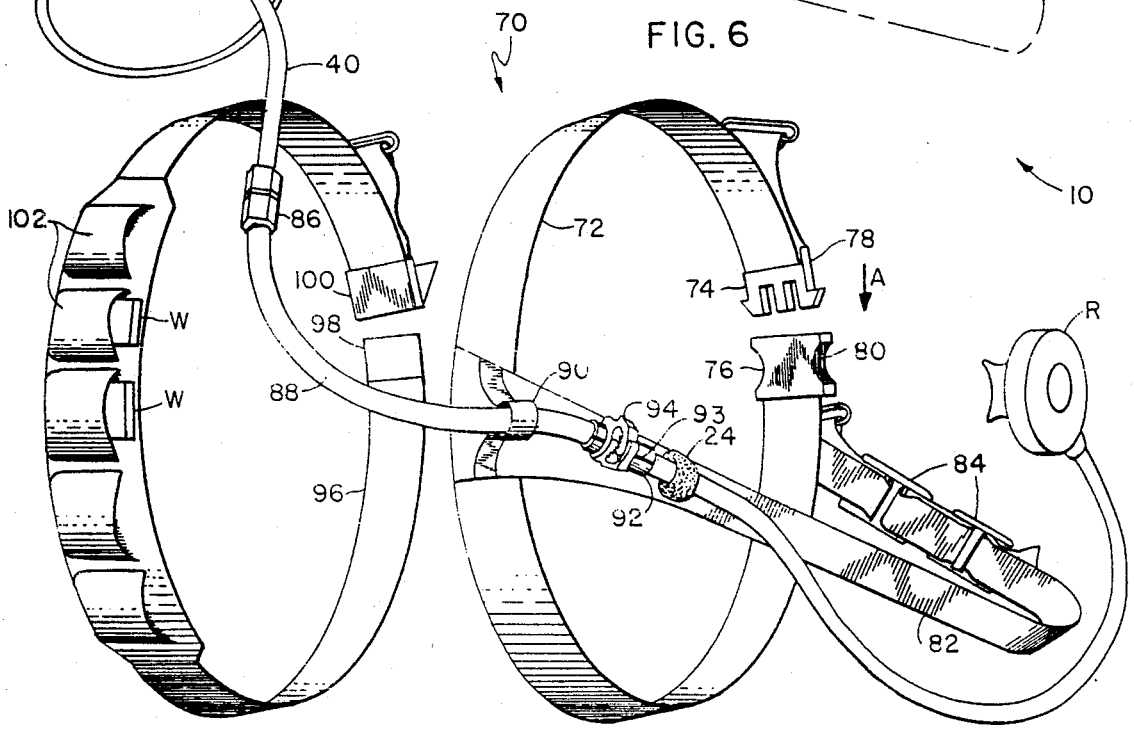

UNDERWATER DIVING SYSTEM

FIELD OF THE INVENTION

The following invention relates generally to an underwater dive system which allows a person to swim underwater for extended periods of time without having to wear a compressed air tank as in scuba diving. The source of compressed air is carried on a raft floating on the surface and is towed by the diver by an air line which extends to the diver and attached by a harness.

BACKGROUND OF THE INVENTION

Curiosity and the desire to explore appear to be innate human characteristics. With respect to large bodies of water such as oceans or lakes, humans are confronted with severe obstacles when exploring because the environment is totally alien. Various devices have been created to make humans more adaptable to an underwater environment, albeit for limited periods of time. Examples include diving bells, diving suits, scuba systems and snorkling equipment. While each of these devices provides access to the world below water, each has significant limitations.

Diving bells, for example, permit one to explore the oceans at almost unlimited depths but restrict the person in maneuverability. While a person is free to move within the diving bell, the underwater observer is constrained by the mechanical efficiency and maneuverability of the bell itself.

Diving suits remove some of the objectionable aspects of a diving bell, but the diver is limited to explore areas within the range of motion prescribed by the "mother ship" from whence his lifeline depends.

While scuba systems do not operate at as great a depth as diving bells or diving suits, the diver is free to roam at will, at least to the extent that he can carry his own air supply. Ultimately, the diver must return to wherever the vessel is located and scuba divers must excercise considerable skill and care both with respect to their equipment and certain survival techniques such as decompression.

Snorkeling involves substantially less sophistication with respect to training, understanding and command of the associated equipment prior to utilization. Because a snorkeler never strays far from the surface, difficulties and complexities with respect to the snorkler's air supply have been minimized.

It is stipulated that a substantial gap exists between the requisite skill level of a snorkeler vis a vis a scuba diver. Whereas anyone is free to purchase and use snorkeling equipment, refilling compressed air tanks and using scuba equipment requires certification. The complexities with respect to diving equipment and decompression create barriers for one who wants to become initially aquainted with the underwater environment with a greater degree of involvement than snorkeling, but without the rigors of scuba diving training and certification.

SUMMARY OF THE INVENTION

Accordingly, the instant invention is distinguished over the known prior art in that an intermediate step is provided between snorkeling and scuba diving to provide an easy transition for the neophyte to progress from snorkeling towards acquiring a skill more closely approximating scuba diving. The instant invention defines a structure which renders it less likely that a newcomer to the underwater environment will fall prey to the dangers inherent in scuba diving which can only be overcome through experience and training.

One of the perceived impediments that a newcomer encounters in scuba diving is the cumbersome nature of the diving equipment itself. Although the weight of compressed air tanks when carried on the back of the diver is offset by its buoyancy in the water, its bulk is not displaced. Thus, the presence of a scuba tank is somewhat deceptive because the presence of the scuba tank may be ignored due to its lack of weight but its bulk can provide clearance problems which may be forgotten by an inexperienced diver. The instant invention overcomes this difficulty by placing the compressed air tank on a raft and only an air line communicates with the diver.

The air line serves several important functions apart from providing the diver with air to breathe. First, it makes diving equipment less cumbersome. Second, the air line is tethered to the raft itself so that the raft follows the diver. Third, the air line is kept at a modest length, typically 20 feet. This limits both the depth to which the diver can go for obvious safety reasons and limits the distance the diver has to travel to return to the safety of the raft. Although it is relatively unlikely that the air line will become entrained in an underwater obstacle, even if this should happen the diver is suffiently close to the surface and the raft to escape. A harness worn by the diver attaches the air hose to the raft and makes towing the raft by the diver effortless.

The raft itself serves other important functions apart from merely carrying the compressed air tank. First, the raft is designed to be "self-bailing". Thus, the raft is not prone to taking on water caused for example by the wake of a boat. Second, the raft serves as a marker which alerts other water enthusiasts as to the presence of a diver in the immediate area. This minimizes the possibility of another boat's keel injuring a diver who is near the surface and within the draft depth of the nearby boat. Third, the raft includes a sight window on a bottom surface or deck of the boat. This provides the diver with information with respect to the prospective diving site. The raft also provides diver transportation to and from the diving site while the diver is supported by the raft. No use of compressed air is needed while relocating to another site. These features add security and safety.

In sum, the instant invention provides substantive benefits derived from scuba diving with the relative freedom and enhanced safety beyond that which is afforded by snorkeling.

OBJECTS OF THE INVENTION

Accordingly, it is a primary object of this invention to provide a new and useful diving system.

It is a further object of this invention to provide a device as characterized above which is extremely safe to use, durable in construction and lends itself to mass production techniques.

It is a further object of this invention to provide a device as characterized above which combines the benefits of scuba diving with even greater safety than that which is experienced when snorkeling.

A further object of this invention is to provide a device as characterized above which includes a harness worn by the diver, a gas line of compressed air attached to the harness and communicating with the diver through a mouth piece, the gas line attached to a source of compressed air carried on a raft, the life line tethered to a raft so that swimming by the diver tows the raft therealong. The raft is configured so as to be self bailing and includes a sight glass along the bottom wall of the raft to allow the diver to select the most appropriate terrain for exploration.

Viewed from one vantage point it is an object of the present invention to provide a device as characterized above in which the underwater diving system includes a light-weight raft, a source of compressed gas carried on the raft, a gas line from the source to an underwater diver, and a harness connecting an end of the line remote from the source to the diver thereby while the diver explores underwater, the raft is towed along and forces associated with towing are dissapated by the harness. The hydrodynamic shape of the raft and light weight of the inflatable pontoons facilitate this.

Viewed from a second vantage point, the instant invention contemplates as an object the provision of an underwater diving system in which a raft formed from a pair of outboard pontoons and interconnected by a membrane defined as a deck, stores a compressed gas container within a compartment on the deck of the raft, such that the compressed gas container depends from the deck, a gas line extends from the container to the diver such that the harness on the diver distributes forces generated while the diver tows the hydrodynamically shaped raft.

Viewed from yet a further vantage point, it is an object of the present invention to provide an underwater diving system in which a raft having a source of compressed gas includes a gas line extending from the source to the diver, the gas line is tethered to a leading portion of the raft and extends down to a harness connected to the gas line and worn by the diver which includes a strap which directs the gas line from the diver's lower back area and over a shoulder to conveniently feed the regulator to the diver's mouth for the admission of air therethrough.

These and other objects will be made manifest when considering the following detailed specification when taken in conjunction with the appended drawing figures.

BRIEF DESCRIPTION OF THE DRAWING FIGURES

FIG. 5 is a perspective view of a bottom of the raft.

FIG. 6 is a bottom view of the raft with the essential diving components shown along with the harness according to the present invention, the raft shown in phantom for purposes of clarity.

BRIEF DESCRIPTION OF THE PREFERRED EMBODIMENT

Figure 1:
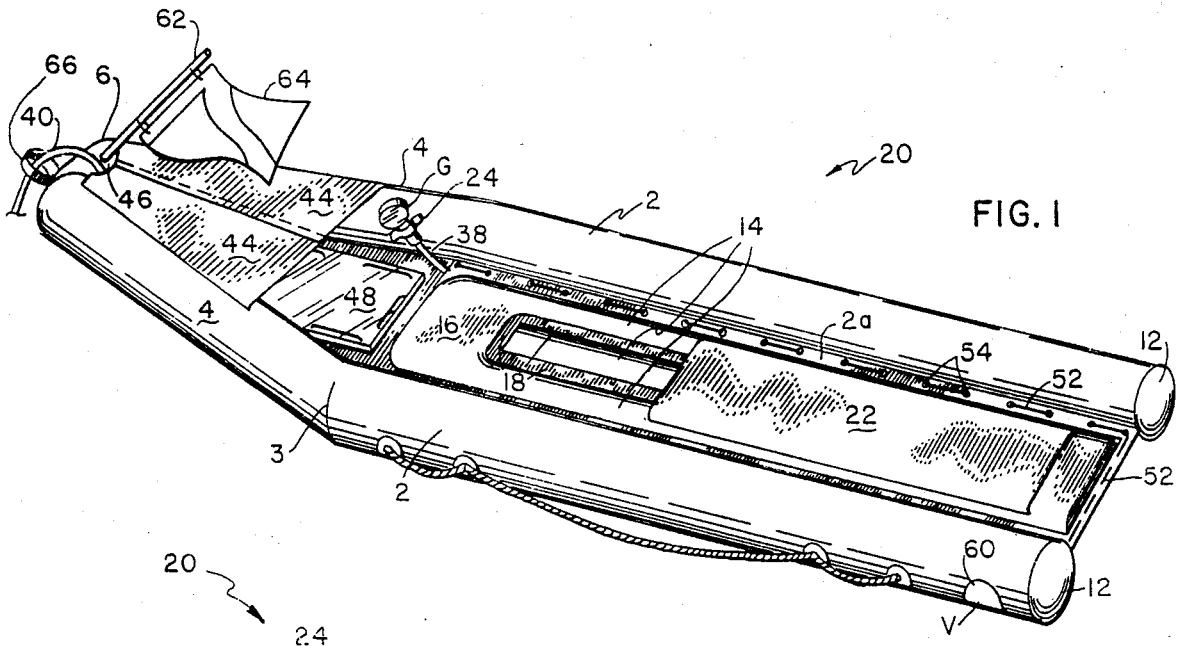
FIG. 1 is a perspective of a top portion of the raft according to the present invention.

Referring to the drawings now, wherein like reference numerals refer to like parts throughout the various drawing figures, reference numeral 10 (FIG. 6) is directed to the underwater diving system according to the present invention. As shown, the diving system 10 includes two major components: a raft 20 and a harness 70.

With respect to the raft 20, FIGS. 1–5 detail certain structural components. In its essence, the raft 20 includes two cylindrical pontoons 2 having an upswept "V" shaped nose 4 and a deck 14 extending between the two pontoons defining the raft. This configuration promulgates hydrodynamic efficiency and safety to be described.

Figure 4:
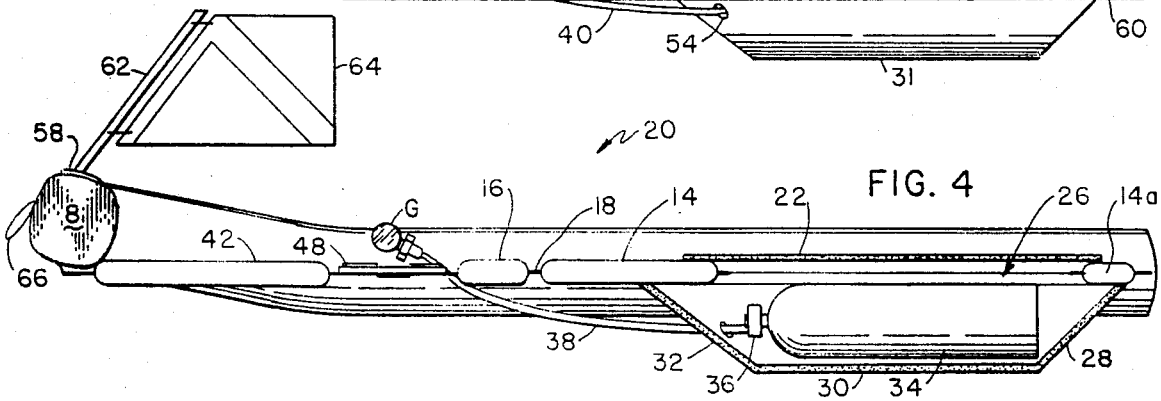
FIG. 4 is a sectional view taken along lines 4—4 of FIG. 2.

More particularly, each cylindrical pontoon 2 includes an end wall 12 at a trailing portion of the raft 20, and each cylindrical pontoon 2 is disposed with respect to the other in spaced parallel configuration. The upswept nose 4 has a substantially V shaped profile when viewed from a top plan view (FIG. 2) and is formed integrally with the cylindrical pontoons 2. That is, the fabric forming the pontoons and the nose along each side of the raft is cut from a single sheet of material and includes no seam at the intersection or transition 3 between the nose 4 and the pontoon cylindrical portion 2. This transItIon 3 necessitates very skillful pattern cutting and fabrication because this would be an area of logical stress where the nose sweeps upwardly. Had there been a seam this would be an area of weakness. The stern of the pontoons include circular end walls 12 providing a rearward air barrier. The bow portion of the raft comes somewhat to a point with the nose portion 4 declinated not only upwardly but inwardly. As shown in FIG. 4, each pontoon 2 connects at the bow portion and a barrier 8 is provided between the two pontoons along the longitudinal center line of the raft thereby providing two air chambers for safety. A trailing portion of the raft reveals two reinforced areas 60 which support valves V allowing fluid communication with the interior of the pontoons 2.

Figure 2:
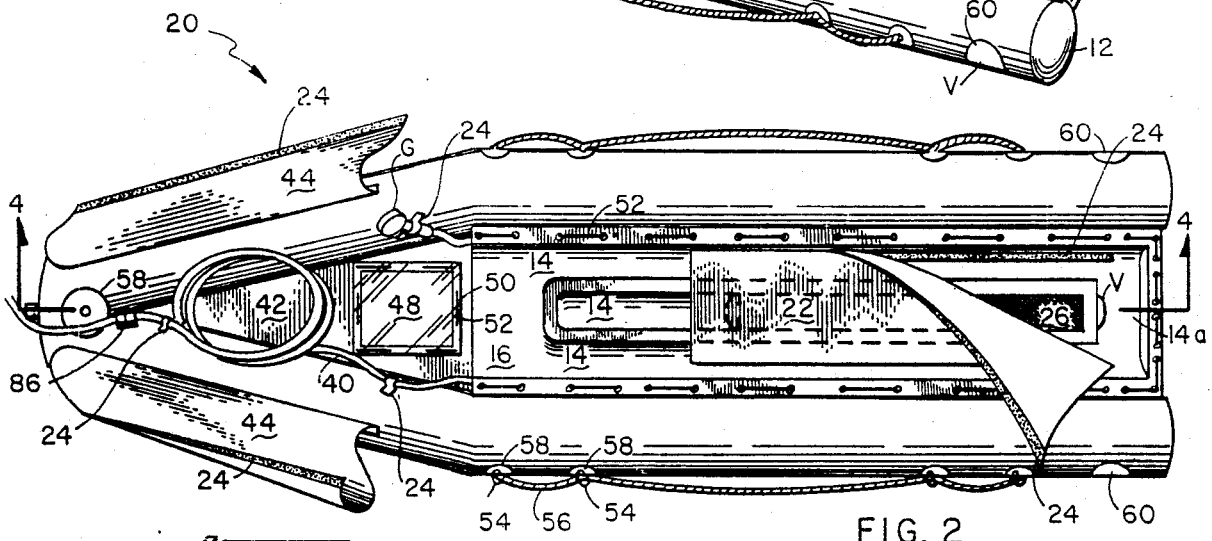
FIG. 2 is a top plan view thereof with various compartments exposed for clarity.
Figure 3:
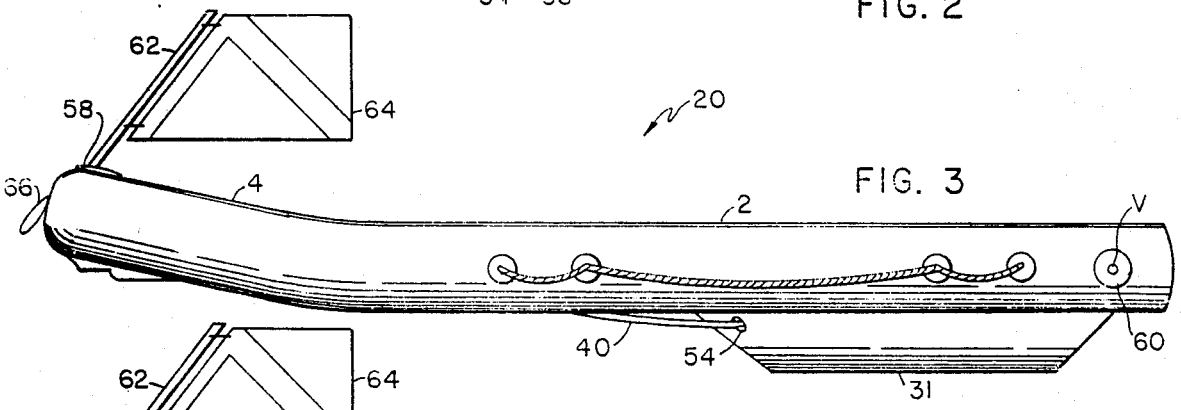
FIG. 3 is a side view of that which is shown in FIGS. 1 and 2.

A deck 14 is provided which spans between the two pontoons 2. As shown in FIGS. 1 and 2 for example, the deck is formed as a membrane having a peripheral border which is attached to the pontoons by means of lacing 52 passing through an edge portion 4*a*, 2*a* of the pontoons and the membrane. Note that edge 4*a* is on a bottom of the raft while edge 2*a* is at the top. This provides a better support surface 14 for the diver. Eyelets 54 reduce the friction and chafing likely to occur at the areas of connection between the deck and pontoons. The deck 14 includes a forward portion 42 which is truncated and substantially "V" shaped and serves as a line storage area as will be explained. At an area of the deck 14 just forward the linear cylindrical pontoons 2 a window 48 is placed passing through the membrane deck 14. The window 48 is attached by a lacing 52 connected to a deck edge 50. The diver when paddling on the water can look through the window 48 to select an appropriate dive area. Immediately aft the window 48, a pillow 16 is integrally formed with the deck 14 to provide comfort for the diver when using the raft. Trailing the pillow 16 and in fluid communication therewith, a series of air passageways extend the length of the deck. Each air passageway forming the deck 14 is interrupted by a seam press 18 which compartmentalizes the air contained within the deck such that only the pillow has a central crown area while the remainder of the deck is "flat", more accurately, a crenelated surface having no prominent central crown. Two valves V inflate the deck 14. One valve is at a bottom leading portion of the raft (FIG. 5); the other (FIG. 2) is near the rear edge of compartment 26.

A trailing portion of the deck 14 includes a cover 22 which overlies an air tank to be discussed. The cover 22 is permanently attached along one edge and is hinged open by means of male and female fastener strips 24 such as those manufactured under the trademark VELCRO connected along another longitudinal edge thereof. FIGS. 2 and 4 depict a depressed compartment 26 within which a tank 34 of compressed air is placed. As shown, the depressed compartment 26 includes a bottom wall 30, a rear wall 28, a front wall 32 and a pair of spaced side walls 31 thereby defining the compartment. In the preferred form of the invention, the compartment walls and cover 22 are formed from foam, preferrably closed cell. It is also preferred the walls defining the compartment have been sculpted such that the recess for receiving the tank 34 is complemental to the external configuration of the tank 34 so that there is negligible free space in the compartment for the tank to roll or move. Several intended benefits are inherent with this design.

First, placement of the compressed tank below the elevation of the pontoons lowers the center of gravity of the raft providing a stable structure which is not only resistant to capsizing, but tends to be self righting. Second, placement of the tank at a trailing portion of the raft adjusts the trim of the raft so that the trailing portion is at a lower elevation. This is further enhanced by having the nose 4 of the raft inclinated upwardly. Third, note the absence of a transom or rear wall transverse to the longitudinal axis of the raft. This allows the raft to be self-bailing and also easily boarded by the user. Since the tank is carried in a covered compartment 26 conforming to the external shape of the tank 34, the compartment will not receive or retain any appreciable amount of water.

Because of the tank compartment construction, air lines extending from the tank can pass through openings on the front wall 32 of the compartment 26 through eyelets 54. The tank 34 includes a two stage valve 36 allowing two lines to proceed forwardly under the raft deck 14 and therefore not interfere with the diver's activities. A gauge line 38 runs under the raft and through another opening terminating in the nose portion of the raft in a gauge "G". The gauge "G" is held in fixed position on one pontoon wall at a nose portion thereof by means of a fastener connection 24. Thus, the diver can know the air pressure within the tank 34 while oriented to look through the viewing window 48. The diver's feed line 40 passes through the deck 14 and into the nose portion of the raft where it is coiled for storage in the line storage area 42.

A top surface of the pontoons overlying the nose portion 4 includes a line front cover 44 formed from two pieces of membrane. Each cover 44 is of substantially triangular configuration having a line outlet 46 formed as an arcuate cutaway adjacent the bow 6 of the boat. The two portions defining the cover 44 can be united by means of fastener 24 configured as an elongate strip along adjacent edges of the cover 44. Cover edges abutting the nose 4 are fixed to the nose. When the line 40 is to be stored, it is coiled under the cover 44 and therefore is less likely to become entrained because it is not depending from the raft when the diver is paddling.

The line 40 exits the forward portion of the raft through the line outlet 46 and is looped through a lanyard 66 at a leading portion of the raft. The line will then be deployed in a manner to be defined shortly.

The remaining details of the raft include a rope 56 attached on lateral outer faces of the pontoon portion 2. The rope 56 is connected to the pontoons 2 by means of D-Ring mounting pad 58 adhered to the side walls of the pontoons 2 in any known manner, such as gluing or heat pressing. The rope 56 is attached to the pads 58 through D-rings 54 and allows the raft to be easily grasped by the diver upon ascent or descent and utilized to board the raft from aft end and for navigation when the diver is not paddling on the raft deck. A further pad 58 is carried on a leading portion or bow of the boat, this pad 58 includes an upwardly extending sleeve which is declinated rearwardly to receive a flag staff 62 which in turn, supports a flag 64. The flag and flag staff make the raft more readily visible to other boats who will proceed in the area immediately proximate the raft with greater care thereby providing greater safety for the diver.

Because the air line 40 passes through a fastener strap 24, it can tow the raft 20 as the diver swims below. The lanyard 66 can be used to tow the raft by another vehicle.

With reference to FIG. 6, the underwater diving system 10 can be explained with respect to the relationship of the raft 20 and the associated harness 70 that the diver wears. As shown, the line 40 extending below the surface of the water communicates with a harness 70 which includes a waist belt 72 that circumscribes the diver. The waist belt 72 includes a girth adjuster 74 so that a free end of the belt can be pulled to accomodate various dimensioned people. The adjuster 72 is integrally formed with a biased catch 78 formed as prongs on opposed sides of the adjuster that fastens to a belt latch 76 carried on a remote extremity of the belt. The belt latch 76 receives the catch 78 by insertion of the catch 78 into the latch 76 according to the direction of the arrow "A" shown in FIG. 6. The latch 76 has two opposed side walls provided with openings 80 defining a receiver for the catch 78. The openings 80 receive the prongs of the biased catch 78 to hold the waist belt securely. By depressing the prongs of the catch 78 and pulling in a direction opposite from the arrow "A", the belt can be removed quickly.

The harness 70 also includes a shoulder belt 82 extending from a rear portion of the belt 72 and is to be looped over the shoulder of the wearer and is fastened to a forward portion of the belt near the belt latch 76. The shoulder strap 82 is provided with a strap adjuster 84 to vary the length of the shoulder strap to accomodate people of different dimensions.

Since the air line 40 is to communicate with a mouth piece regulator "R" for the diver and because the air line 40 is to tow the raft 20, the harness is constructed to support the air line in such a manner that the forces associated with towing the raft are not encountered by the mouth area of the diver but instead are dissipated along the person's body to make the tether to the raft hardly discernable. The air line 40 couples to a harness section of the air line 88 through a quick-disconnect coupling 86 for safety. The harness air line 88 is first tethered to the shoulder strap 82 near where the shoulder strap joins the waist belt 72 at a lower back area of the diver. This back area is shown in FIG. 6 as being a portion opposite from the latch 76 and catch 78. A loop 90 supports the weight and forces exerted by the raft on the diver. In addition, a fastener strap 24 is provided up from the belt area on the shoulder strap 82 and tethers the harness air line 88. Interposed between the velcro strap 24 and the loop 90 is a chafe liner 92 configured as a rubber sleeve having a longitudimal slit 93 overlying the harness air line 88. Circumscribing the chafe linêr 92 is a clamp 94 radially constricting the chafe liner 92. Thus, the clamp 94 and chafe liner 92 provide limits in harness air line 88 motion between loop 90 and velcro 24 as a safety feature. An alternative would be to attach clamp 94 directly to line 88 and constrain axial movement via annular stops on either side of the clamp 94.

Assume that the line 40 is snagged in some manner. The presence of the clamp 94 assures that the regulator "R" will not be pulled from the mouth of the diver. This gives the diver sufficient time to explore the nature of the snag and take appropriate action. Since the air line 40 is contemplated as having a maximum length of approximately 20 feet, the diver has several options available. The diver can either unsnag the line, disconnect coupling 86 or release the harness and surface safely. Note further coupling 86 on the nose portion (FIG. 2). This coupling allows a snagged line to be dropped if necessary. This coupling also allows two diving lines to be used if the coupling includes a "Y" adapter (line bifurcation. This system would be helpful when training a diver, rescue operation, etc. Clearly, more than two lines could be provided if desired.

As an additional safety feature, it is proposed that a weight belt not be integrally formed with the harness. As shown in FIG. 6, a weight belt 96 having a free end 98 connects to a buckle 100 that includes a girth adjustment not too dissimilar from an auto seat belt. The weight belt 96 includes a plurality of weight pockets 102 within which weights "W" are carried. Removal allows the diver to proceed to the surface effortlessly.

In use and operation, the diver paddles to an appropriate area for underwater exploration as determined through the viewing window 48, checks that the tank has sufficient air through the gauge "G", dons the harness and weight belt, uses the air line 40 and proceeds to explore below the water with the raft following the diver as described. Moreover, having thus described the invention, it should be apparent that numerous structural modifications and adaptations may be resorted to without departing from the scope and fair meaning of the instant invention as suggested hereinabove and delineated and defined hereinbelow in the claims.

I claim:

1. An underwater diving system, comprising in combination:

a light-weight raft, a source of compressed gas embodied as a scuba type tank of compressed gas normally carried on the back of a diver carried on said raft, a gas line from said source to an underwater diver, and harness means connecting an end of said line, remote from said gas source, to the diver, whereby while the diver explores underwater, said raft is towed along and forces associated with towing are dissipated by said harness.

2. The system of claim 1 wherein said raft includes a compartment within which said source of compressed gas is disposed, said compartment provided in depending relation from a deck area of said raft, whereby the weight of said compressed gas source lowers the center of gravity of said raft and enhances the raft's ability to resist capsizing and promulgates self-righting.

3. The system of claim 2 wherein a trailing portion of said raft is open ended and said compartment is disposed adjacent thereto, thereby adjusting the trim of said raft and providing a self-bailing raft.

4. The system of claim 3 wherein said compartment has a recessed configuration complimental to an external configuration of said source of said compressed gas, a cover seals access to said compartment, and said source of gas includes first and second lines extending therefrom under the raft and entering a nose portion of said raft through said deck thereby providing a diver occupant area unobstructed by hose lines.

5. The system of claim 4 wherein said nose portion includes an area for receiving a length of line communicating with said source of compressed air, a cover overlying said air line area including an arcuate opening adjacent said nose of said raft allowing the line to pass therethrough and thence downwardly into the water, said nose portion further including a sight window to allow the diver a view of the underlying underwater terrain.

6. The system of claim 5 wherein said raft is formed from first and second pontoons having a rear portion of substantially elongate cylindrical dimension, a nose portion angled upwardly and inwardly to form a substantially "V" shaped nose, thereby defining a hydrodynamic shape for stable, in-line towing, and said deck includes a plurality of inflated passageways interrupted by a pattern of pressed seams thereby minimizing any formation of a central crown with respect to said deck, and a pillow interposed between said sight window and said seams for providing support of the diver when viewing through said sight window, said harness means including first and second loops adjacent a lower back area of the diver directing said air line over a shoulder of the diver and providing resistance to a tendency for removal of a regulator from a mouth of the diver at a terminal portion of said air line should said air line encounter a snag.

7. An underwater diving system, comprising in combination:

a raft including a pair of outboard pontoons interconnected by a membrane defining a deck, compressed gas means depending from said deck whereby said deck is unobstructed to support a diver thereon, a gas line extending from said raft to a diver and coupled to said gas means, and harness means on the diver distributing forces generated from the diver towing the raft with said gas line.

8. The system of claim 7 wherein said raft includes a compartment within which said compressed gas means is disposed, said compartment provided in depending relation from said deck area of said raft, whereby the weight of said compressed gas means lowers the center of gravity of said raft and enhances the raft's ability to resist capsizing and promulgates self-righting.

9. The system of claim 8 wherein a trailing portion of said raft is open ended and said compartment is disposed adjacent thereto, thereby adjusting the trim of said raft, providing a self-bailing raft and boarding ease for the diver.

10. The system of claim 9 wherein said compartment has a recessed configuration complimental to an external configuration of said compressed gas means, a cover seals access to said compartment, and said compressed gas means includes first and second lines extending therefrom under the raft and entering a nose portion of said raft through said deck thereby providing a diver occupant area unobstructed by hose lines.

11. The system of claim 10 wherein said nose portion includes an area for receiving a length of line communicating with said compressed gas means, a cover overlying said air line area including an arcuate opening adjacent the nose of said raft allowing the line to pass therethrough and thence downwardly into the water, said nose portion further including a sight window to allow the diver a view of the underlying underwater terrain.

12. The system of claim 11 wherein said raft is formed from first and second pontoons having a rear portion of substantially elongate cylindrical dimension, a nose portion angled upwardly and inwardly to form a substantially "V" shaped nose, and said deck includes a plurality of inflated passageways interrupted by a pattern of pressed seams thereby minimizing any formation of a central crown with respect to said deck, and a pillow interposed between said sight window and said seams for providing support of the diver when viewing through the sight window, said harness means including first and second loops adjacent a lower back area of the diver directing said air line over a shoulder of the diver and providing resistance to a tendency for removal of a regulator from a mouth of the diver at a terminal portion of said air line should said air line encounter a snag.

13. An underwater diving system comprising in combination:

an inflated raft containing air making said raft buoyant and supporting a source of compressed gas, said gas source having a plural stage valve, a gas line extending from said source through said plural stage valve and to a diver, a mouthpiece regulator between the diver and said gas line, and harness means connected to said gas line and worn by the diver including a strap which directs said gas line from a lower back area and over a shoulder of the diver.

14. The system of claim 13 wherein said raft includes a compartment within which said source of compressed gas is disposed, said compartment provided in depending relation from a deck area of said raft, whereby the weight of said compressed gas source lowers the center of gravity of said raft and enhances the raft's ability to resist capsizing and promulgates self-righting.

15. The system of claim 14 wherein a trailing portion of said raft is open ended and said compartment is disposed adjacent thereto, thereby adjusting the trim of said raft and providing a self-bailing raft.

16. The system of claim 15 wherein said compartment has a recessed configuration complimental to an external configuration of said source of said compressed gas, a cover seals access to said compartment, and said source of gas includes first and second lines extending therefrom under the raft and entering a nose portion of said raft through said deck thereby providing a diver occupant area unobstructed by hose lines.

17. The system of claim 16 wherein said nose portion includes an area for receiving a length of line communicating with said source of compressed air, a cover overlying said air line area including an arcuate opening adjacent the nose of said raft allowing the line to pass therethrough and thence downwardly into the water, said nose portion further including a sight window to allow the diver a view of the underlying underwater terrain.

18. The system of claim 17 wherein said raft is formed from first and second pontoons having a rear portion of substantially elongate cylindrical dimension, a nose portion angled upwardly and inwardly to form a substantially "V" shaped nose, and said deck includes a plurality of inflated passageways interrupted by a pattern of pressed seams thereby minimizing any formation of a central crown with respect to said deck, and a pillow interposed between said sight window and said seams for providing support of the diver when viewing through said sight window, said harness means including first and second loops adjacent a lower back area of the diver directing said air line over a shoulder of the diver and providing resistance to a tendency for removal of a regulator from a mouth of the diver at a terminal portion of said air line should said air line encounter a snag.

19. An underwater diving system, comprising in combination:

a light-weight raft, a source of compressed gas carried on said raft, a gas line from said source to an underwater diver, and harness means connecting an end of said line, remote from said source, to the diver, whereby while the diver explores underwater, said raft is towed along and forces associated with towing are dissipated by said harness, wherein said raft includes a compartment within which said source of compressed gas is disposed, said compartment provided in depending relation from a deck area of said raft, whereby the weight of said compressed gas source lowers the center of gravity of said raft and enhances the raft's ability to resist capsizing and promulgates self-righting, wherein a trailing portion of said raft is open ended and said compartment is disposed adjacent thereto, thereby adjusting the trim of said raft and providing a self-bailing raft.

20. An underwater diving system, comprising in combination:

a light-weight raft, a source of compressed gas carried on said raft, a gas line from said source to an underwater diver, and harness means connecting an end of said line, remote from said source, to the diver, whereby while the diver explores underwater, said raft is towed along and forces associated with towing are dissipated by said harness, wherein a trailing portion of said raft is open ended and a compartment containing said gas depends adjacent thereto, thereby adjusting the trim of said raft and providing a self-bailing raft.

21. An underwater diving system, comprising in combination:

a raft including a pair of outboard pontoons interconnected by a membrane defining a deck, compressed gas means contained by said deck, a gas line extending from said raft to a diver and coupled to said gas means, and harness means on the diver distributing forces generated from the diver towing the raft with said gas line, wherein said raft includes a compartment within which said compressed gas means is disposed, said compartment provided in depending relation from said deck area of said raft, whereby the weight of said compressed gas means lowers the center of gravity of said raft and enhances the raft's ability to resist capsizing and promulgates self-righting, wherein a trailing portion of said raft is open ended and said compartment is disposed adjacent thereto, thereby adjusting the trim of said raft, providing a self-bailing raft and boarding ease for the diver.

22. An underwater diving system, comprising in combination:

a raft including a pair of outboard pontoons interconnected by a membrane defining a deck, compressed gas means contained by said deck, a gas line extending from said raft to a diver and coupled to said gas means, and harness means on the diver distributing forces generated from the diver towing the raft with said gas line, wherein a trailing portion of said raft is open ended and a compartment containing said gas means depends adjacent thereto, thereby adjusting the trim of said raft and providing a self-bailing raft and boarding ease for the diver.

23. An underwater diving system comprising in combination:

a raft having a source of compressed gas, a gas line extending from said source to the diver, and harness means connected to said gas line and worn by the diver including a strap which directs said gas line from a lower back area and over a shoulder of the diver, wherein said raft includes a compartment within which said source of compressed gas is disposed, said compartment provided in depending relation from a deck area of said raft, whereby the weight of said compressed gas source lowers the center of gravity of said raft and enhances the raft's ability to resist capsizing and promulgates self-righting, wherein a trailing portion of said raft is open ended and said compartment is disposed adjacent thereto, thereby adjusting the trim of said raft and providing a self-bailing raft.

24. An underwater diving system comprising in combination:

a raft having a source of compressed gas, a gas line extending from said source to the diver, and harness means connected to said gas line and worn by the diver including a strap which directs said gas line from a lower back area and over a shoulder of the diver, wherein a trailing portion of said raft is open ended and a compartment containing said gas depends adjacent thereto, thereby adjusting the trim of said raft and providing a self-bailing raft.

25. An underwater diving system, comprising in combination:

a raft including a pair of outboard pontoons interconnected by a membrane defining a deck, compressed gas means contained by said deck which said deck has a sight window passing therethrough, a gas line extending from said raft to a diver and coupled to said gas means, said gas means embodied as a scuba type tank of compressed gas normally carried on the back of a diver, and harness means on the diver distributing forces generated from the diver towing the raft with said gas line.

26. An underwater diving system, comprising in combination:

a light-weight raft, a source of compressed gas embodied as a tank of gas under pressure which has a plural stage valve, said tank carried on said raft, a gas line from said source to an underwater diver, and harness means connecting an end of said line, remote from said gas source, to the diver, said gas line end remote from said tank having a mouthpiece regulator, whereby while the diver explores underwater, said raft is towed along and forces associated with towing are dissipated by said harness and the diver breathes through said mouthpiece regulator.

27. An underwater diving system, comprising in combination:

a light-weight raft dimensioned to support a person, an independent source of compressed gas embodied as a scuba type tank of compressed gas normally carried on the back of a diver carried on said raft, a gas line from said source to an underwater diver, and harness means connecting an end of said line, remote from said source, to the diver, whereby while the diver explores underwater, said raft is towed along and forces associated with towing are dissipated by said harness.

* * * * *

US004919631B1

REEXAMINATION CERTIFICATE (3388th)

United States Patent [19] [11] B1 4,919,631

Stafford [45] Certificate Issued Nov. 25, 1997

[54] UNDERWATER DIVING SYSTEM

[75] Inventor: Michael V. Stafford, Placerville, Calif.

[73] Assignee: Snuba International, Inc., Placerville, Calif.

Reexamination Request:
No. 90/004,495, Nov. 7, 1996

Reexamination Certificate for:

| | |
|---|---|
| Patent No.: | **4,919,631** |
| Issued: | **Apr. 24, 1990** |
| Appl. No.: | **190,631** |
| Filed: | **May 5, 1988** |

[51] Int. Cl.[6] ..... B63C 11/20

[52] U.S. Cl. ..... 441/40; 114/315; 405/186

[56] References Cited

U.S. PATENT DOCUMENTS

| | | | |
|---|---|---|---|
| 1,401,724 | 12/1921 | Palij | 405/186 |
| 3,045,262 | 7/1962 | Mitchell . | |
| 3,324,819 | 6/1967 | Tetyak | 114/66 |
| 3,566,425 | 3/1971 | Welty | 114/345 |
| 4,348,976 | 9/1982 | Gilbert | 114/270 |
| 4,645,465 | 2/1987 | Courtney . | |
| 4,674,493 | 6/1987 | Mitchell | 128/202.14 |

FOREIGN PATENT DOCUMENTS

| | | |
|---|---|---|
| 1522520 | 4/1968 | France . |
| 2036255 | 12/1970 | France . |
| 2119265 | 8/1972 | France . |
| 2635617 | 2/1978 | Germany . |
| 3513515 | 10/1986 | Germany . |
| 2148128 | 5/1985 | United Kingdom . |

OTHER PUBLICATIONS

NOAA Diving Manual, Diving for Science and Technology, Second Ed. Dec., 1979, United States Department of Commerce entire manual.

U.S. Navy Diving Manual, vol. 1 Air Diving, Revision 1, Jun. 1, 1985 Supervisor of Diving, United States Navy, pp. 4–6, 4–14, 4–15, 4–18, 4–25, 4–27, 6–38, 6–39, 6–43, 6–57 –60, 6–66, 6–67, F–1–4.

Brownie's Third Ling Advertisement, Fort Lauderdale, Fla.

Super Snorkel, Innovative Designs, Inc., "Skin Diver", p. 25 Sep. 1985.

"More able to go into sea and see", The Maui News, Tom Stevens.

*Primary Examiner*—Sherman D. Basinger

[57] ABSTRACT

An underwater diving system including a raft configured to support and carry a compressed air tank in such a manner that the raft is extremely stable and is self-bailing and self-righting because of its configuration, a diving harness communicating with the on-board compressed air source so that the diver is tethered and tows the raft while diving underwater at nominal depths up to 20 feet, for example. The diving system described herein bridges the gap that exists between snorkeling and scuba diving.

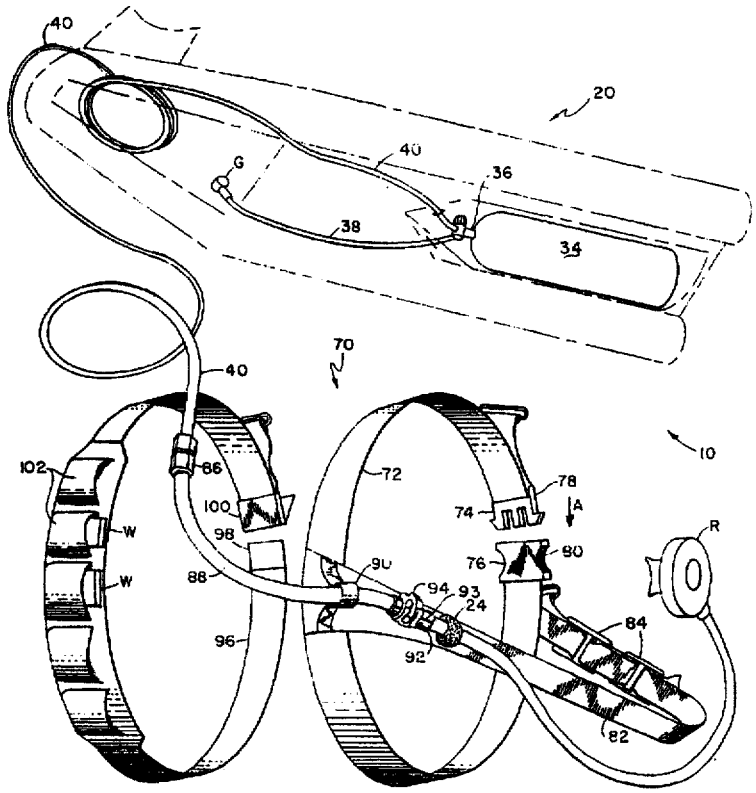

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 7–25 is confirmed.

Claims 1, 26 and 27 are determined to be patentable as amended.

Claims 2–6, dependent on an amended claim, are determined to be patentable.

1. An underwater diving system, comprising in combination:

a light-weight raft *which remains on the surface of the water while a diver explores underwater,* a source of compressed gas embodied as a scuba type tank of compressed gas normally carried on the back of a diver carried on said raft, a gas line from said source to [an underwater] *the* diver, and harness means connecting an end of said line, remote from said gas source, to the diver, whereby while the diver explores underwater, said raft is towed along and forces associated with towing are dissipated by said harness.

26. An underwater diving system, comprising in combination:

a light-weight raft *which remains on the surface of the water while a diver explores underwater,* a source of compressed gas embodied as a tank of gas under pressure which has a plural stage valve, said tank carried on said raft, a gas line from said source to [an underwater] *the* diver, and harness means connecting an end of said line, remote from said gas source, to the diver, said gas line end remote from said tank having a mouthpiece regulator, whereby while the diver explores underwater, said raft is towed along and forces associated with towing are dissipated by said harness and the diver breathes through said mouthpiece regulator.

27. An underwater diving system, comprising in combination:

a light-weight raft dimensioned to support a person *which remains on the surface of the water while a diver explores underwater,* an independent source of compressed gas embodied as a scuba type tank of compressed gas normally carried on the back of a diver carried on said raft, a gas line from said source to [an underwater] *the* diver, and harness means connecting an end of said line, remote from said source, to the diver, whereby while the diver explores underwater, said raft is towed along and forces associated with towing are dissipated by said harness.

* * * * *